United States Patent [19]

Skinner

[11] 3,943,903

[45] Mar. 16, 1976

[54] LIQUID FUEL INJECTION PUMPING APPARATUS

[75] Inventor: Robert Thomas John Skinner, High Wycombe, England

[73] Assignee: C. A. V. Limited, Birmingham, England

[22] Filed: July 12, 1974

[21] Appl. No.: 488,149

[30] Foreign Application Priority Data

July 14, 1973 United Kingdom ..... 33670/73

[52] U.S. Cl. ..... 123/139 R; 123/140 R

[51] Int. Cl.[2] ..... F02M 63/00

[58] Field of Search .. 123/139 AM, 140 R, 140 FG, 123/139 AL, 139 AS, 140 A, 139 R

[56] References Cited

UNITED STATES PATENTS

| | | | |
|---|---|---|---|
| 3,547,092 | 12/1970 | Knight | 123/140 R |
| 3,592,176 | 7/1971 | Fenne | 123/139 AM |
| 3,644,064 | 2/1972 | Eckert et al. | 123/140 FG |
| 3,724,823 | 4/1973 | Littlehales | 123/139 AM |

*Primary Examiner*—Wendell E. Burns
*Assistant Examiner*—James W. Cransen, Jr.
*Attorney, Agent, or Firm*—Holman & Stern

[57] ABSTRACT

A fuel injection pumping apparatus for supplying fuel to an internal combustion engine in which there is provided a feed pump which supplies fuel from its outlet to an injection pump by way of a throttle valve. The outlet pressure of the feed pump is controlled by a relief valve which includes a valve element movable by the outlet pressure of the feed pump to spill fuel between the inlet and outlet of the feed pump. The valve element is subjected to a pressure which is generated by a device and which varies in accordance with the square of the speed at which the apparatus is driven. A pair of restrictors are disposed in a flow path between the outlet of the feed pump and the device and a branch conduit applies the pressure intermediate the restrictors to a fluid pressure operable device which controls the operation of the injection pump. One of the aforesaid pair of restrictors is adjustable in accordance with the setting of the throttle valve whereby the pressure of fuel supplied to the fluid pressure operable device will depend upon the amount of fuel supplied to the associated engine.

12 Claims, 13 Drawing Figures

LIQUID FUEL INJECTION PUMPING APPARATUS

BACKGROUND OF THE INVENTION

This invention relates to liquid fuel injection pumping apparatus for supplying fuel to internal combustion engines, and of the kind comprising an injection pump driven in timed relationship with an associated engine, fluid pressure operable means for effecting adjustment of a component of the injection pump, a feed pump for supplying fuel to the injection pump during the filling periods thereof, and a throttle valve for controlling the amount of fuel supplied to the injection pump.

OBJECTS AND SUMMARY OF THE INVENTION

The object of the invention is to provide such an apparatus in a simple and convenient form.

According to the invention, an apparatus of the kind specified comprises a relief valve including a valve member movable by the outlet pressure of the feed pump to an open position in which fuel is spilled from the outlet of the feed pump, resilient means acting to urge the valve member to the closed position, means for generating a first pressure which is lower than the outlet pressure of the feed pump, but which varies in accordance with the speed at which the apparatus is driven, conduit means through which said first pressure is applied to said valve member to assist the action of the resilient means, whereby the outlet pressure of the feed pump has a value higher than said first pressure, a further conduit interconnecting the outlet of the feed pump and said means whereby flow of fuel will occur along said further conduit due to the difference in pressure between the ends thereof, a pair of restrictors in said further conduit, a branch conduit extending from intermediate said restrictors, and through which the pressure intermediate said restrictors is transmitted to said fluid pressure operable means, with the size of one of said restrictors being adjustable in accordance with the setting of the throttle valve whereby the fluid pressure applied to said fluid pressure operable means will depend both upon the speed at which the apparatus is driven, and also upon the setting of the throttle valve.

BRIEF DESCRIPTION OF THE DRAWINGS

Examples of fuel pumping apparatus in accordance with the invention, will now be described with reference to the accompanying drawings, in which.

DETAILED DESCRIPTION OF THE EMBODIMENTS

Figure 1:
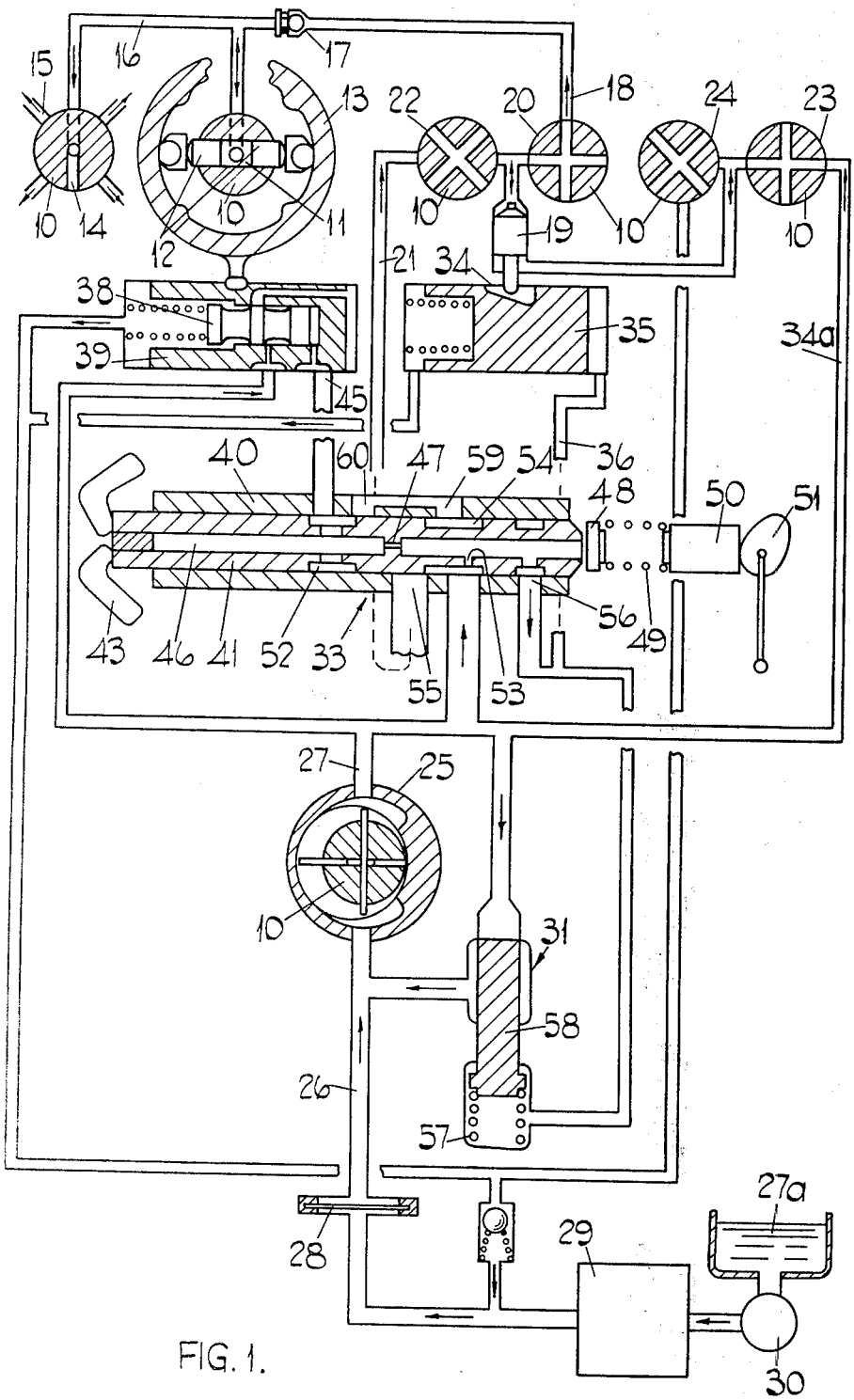
FIG. 1 is a diagrammatic representation of one example of an apparatus in accordance with the invention.

Referring to FIG. 1 of the drawings, the apparatus comprises a body part in which is journalled a rotary cylindrical distributor member 10 which is shown divided into seven parts. The distributor member is adapted to be driven in timed relationship with the engine with which the apparatus is associated, and at one point, in the distributor member there is formed a transversely extending bore 11 in which is mounted a pair of reciprocable pumping plungers 12. Surrounding the distributor member at this point is an annular cam ring 13 having on its internal periphery, a plurality of pairs of diametrically disposed cam lobes. The cam lobes, through the intermediary of rollers respectively, act upon rotation of the distributor member, to move the pumping plungers 12 inwardly thereby to expel fuel contained within the transverse bore 11. The pumping plungers 12, together with the cam lobes constitute an injection pump.

The transverse bore 11 communicates with a passage 16 extending within the distributor member, and at one point this passage communicates with an outwardly extending delivery passage 14 which is adapted to register in turn, and as the distributor member rotates, with a plurality of outlet ports 15 formed in the body part. The outlet ports, in use, are connected to the injection nozzles respectively of the associated engine.

The passage 16 is in communication, by way of a check valve 17, with a passage 18, and this passage can be brought into communication with one end of a bore containing a slidable shuttle 19, by means of a rotary valve 20. The aforesaid one end of the bore at other times, as will be explained, can be placed in communication with a feed passage 21 by means of a rotary valve 22.

The other end of the bore containing the shuttle can be placed in communication with a source of fuel at a high pressure by means of a rotary valve 23 or with a source of fuel at low pressure by means of a rotary valve 24. The valves 20, 22, 23 and 24 are formed in or on the distributor member 10 and are driven in timed relationship with the engine. In addition, also mounted on the distributor member is a feed pump 25 of the rotary vane type and having an inlet 26 and an outlet 27. The inlet 26 is in communication with a supply of fuel 27*a* by way of a pair of filter units 28, 29 and a lift pump 30 is provided to ensure the supply of fuel to the feed pump. The output pressure of the feed pump 25 is controlled by a relief valve 31, the function of which will be described later in the specification. The outlet 27 of the feed pump communicates, by way of a passage 34*a*, with the valve 23, the purpose of which has already been explained.

The operation of the apparatus thus far described is as follows.

With the parts of the apparatus in the position shown in FIG. 1, fuel is flowing from the outlet of the feed pump by way of the valve 23 to said other end of the bore containing the shuttle 19 and the shuttle is being moved towards said one end of the bore. Fuel is therefore displaced from this end of the bore, and flows by way of the rotary valve 20 and the check valve 17 to the passage 16 and particularly to the bore 11. The plungers 12 are therefore moved outwardly by an amount dependent upon the quantity of fuel displaced by the shuttle 19.

During continued rotation of the distributor member, the passage 14 is brought into register with an outlet port 15, and during this time, the plungers 12 are moved inwardly, and fuel is displaced from the bore 11 to the appropriate engine cylinder. Also during this time, the rotary valves 20 and 23 are closed and valves 22 and 24 are open so that fuel now flows to said one end of the bore containing the shuttle 19, and the shuttle is therefore moved towards the other end of the bore. The quantity of fuel which is supplied to the bore containing the shuttle is controlled by a metering valve 33, which will be described later and this therefore determines the quantity of fuel which is supplied to the injection pump during a filling stroke, and thereby, the amount of fuel which is supplied to the associated engine at each injection stroke. During continued rotation of the distributor member, the process described is repeated, and fuel is supplied to the engine cylinders in turn.

It will be appreciated that the shuttle 19 determines the maximum quantity of fuel which can be supplied by the apparatus at each injection stroke. The maximum quantity of fuel which is supplied to an engine is varied in accordance with the speed of the engine to provide shaping of the maximum fuel characteristic so that the maximum excursion of the shuttle must be made to vary in accordance with the speed of the engine. For this purpose, the shuttle 19 is provided with an extended end portion which can co-operate with a cam surface 34 formed on a spring loaded piston 35. The piston is movable against the action of its spring, by means of fuel supplied under pressure to one end of the cylinder by way of a passage 36. The pressure of the fuel which is supplied to the passage is dependent upon the speed at which the apparatus is driven, and the way in which it is derived will be explained later. The effect is that the axial setting of the piston 35 will be dependent upon the speed of the associated engine, and thereby the allowed excursion of the shuttle 19 will also be dependent upon the engine speed.

There is also provided a fluid pressure operable member in the form of a servo-piston 39, and this is connected to the cam ring 13 by means of a peg. The piston 39 is provided with a bore in which is mounted a spring loaded servo-valve 38. The servo-valve controls the admission or escape of fuel under pressure to and from one end of the cylinder containing the piston 39. The fuel under pressure supplied to the cylinder is derived from the outlet 27 of the feed pump, and the servo-valve 38 is subjected to a pressure existing in a branch conduit 45. As this pressure increases, the servo-valve 38 will be moved against the action of its spring towards the left as seen in FIG. 1, and the servo-piston will follow this movement, thereby moving the cam ring 13 angularly and altering the timing of injection of fuel to the engine. Considering now the metering valve 33 this comprises a sleeve 40 which is fixed within the body of the apparatus. Within the sleeve there is mounted an axially slidable rod member 41, which at one end is provided with a head against which bear the toe portions of as illustrated, a pair of governor weights 43. The weights are mounted within a cage not shown, and the latter is driven by gearing from the distributor member 10 so that the speed of rotation of the weights is directly proportional to the speed at which the engine is driven. Extending axially within the rod member is a bore 46 which, at its end adjacent the weights, is closed by a plug. Moreover, intermediate its ends, the bore is provided with a restrictor 47. At its opposite end, the bore 46 is obturated by a valve member 48, with the latter being loaded by means of a coiled compression spring 49. The opposite end of the coiled compression spring is engaged by a movable abutment 50, the axial setting of which and thereby the force exerted by the spring 49, can be adjusted by means of a cam 51 connected to an operator adjustable member. The portion of the bore 46 which is closed by the plug, is in constant communication with the branch conduit 45, with this being achieved by a circumferential groove 52 on the rod member which is in constant communication with a port in the sleeve member 40, and communicating with the branch conduit 45. The other end of the passage 46 is in communication, by way of a restrictor 53, with a further circumferential groove 54 formed on the rod member. Moreover, formed in the sleeve is a port 55 which is in communication with the passage 21. The port 55 is positioned so that the groove 54 can have partial registration therewith for the purpose to be explained. Furthermore, the circumferential groove 54 is in constant communication with the outlet 27 of the feed pump by way of a further port formed in the sleeve.

Figure 2:
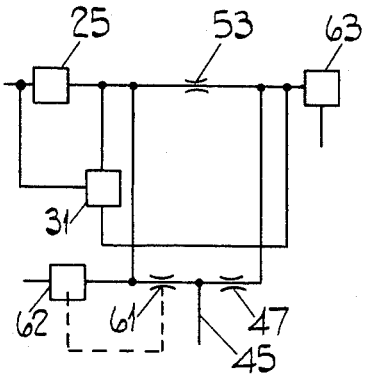
FIG. 2 is a fluid circuit diagram of a portion of the apparatus as seen in FIG. 1.

The right hand portion of the bore 46 is in constant and unrestricted communication by way of a further circumferential groove and a port 56, with the passage 36 which communicates with one end of the cylinder containing the piston 35. In addition, the port 56 is in constant and unrestricted communication with the chamber which contains a spring 57 which loads a valve member 58 of the relief valve 31. The spring 57 urges the valve member 58 towards the closed position in which no fuel is spilled from the outlet of the feed pump. Finally, there is formed in the sleeve, a pair of spaced and communicating ports 59, 60. The port 59 is in constant communication with the circumferential groove 54, and the port 60 can register to a varying amount depending upon the axial position of the rod member 41, with the circumferential groove 52. The port 60 and circumferential groove 52 constitute a variable restrictor 61 seen in FIG. 2. Also seen in FIG. 2 is a throttle valve 62, with the latter being constituted by the port 55 and the circumferential groove 54, and also shown in FIG. 2 is a block 63 which represents the rod member 41, the weights 43 and the valve member 48.

In operation, the axial setting of the rod 41 is dependent upon the speed at which the engine is driven, and as the engine speed increases, the weights 43 will be moved outwardly thereby imparting, as shown in FIG. 1, movement towards the right against the action of the spring 49. As explained, the force exerted by the spring 49 can be varied, and if the spring force is increased, then for a given engine speed, the rod member will move towards the left against the action of the weights. The fuel pressure existing in the right hand end of the bore 46 is, by virtue of the restrictor 53 and the valve member 48, proportional to the square of the speed at which the engine is driven. In fact, the valve member 48 will be lifted slightly from the end of the passage 46 so that flow of fuel will occur through the restrictor 53. If for any reason, there is a tendency for the pressure to increase at a given speed, then the valve member will lift further to an increased flow of fuel.

The pressure in the right hand end of the passage 46 is allowed to act upon the valve member 58 of the relief valve 31 and in so doing it enhances the force exerted by the spring 57. The outlet pressure of the feed pump therefore will have a valve which is higher than the pressure existing in the right hand end of the passage 46 by an amount dependent upon the spring force.

The axial position of the rod member 41 determines the amount of fuel which flows to the injection pump during the filling strokes thereof. This, of course, is controlled by the throttle valve 62, which as previously stated, is represented by the port 55 and the circumferential groove 54. As the engine speed decreases for a given setting of the abutment 50, the groove 54 will move further into register with the port 55 thereby allowing an increased flow of fuel to the engine. Conversely, if the engine speed should increase, the amount of fuel flowing will be reduced. It will be seen therefore that a governor action is obtained. If the abutment 50 is moved by the operator, then movement of the rod 41 will occur until a new equilibrium position is established, and if, for example, the abutment 50 is moved towards the left, more fuel will be supplied to the engine so that the engine speed will increase. Conversely, if the abutment is moved towards the right, the amount of fuel supplied to the engine will decrease and therefore the engine speed will decrease.

The pressure which is applied through the branch conduit 45 will also be dependent upon the setting of the rod member 41. As the rod moves towards the left, then the size of the restrictor 61 will be reduced so that the pressure supplied by way of the branch conduit will more nearly approach the pressure existing in the right hand end of the passage 46, that is to say, it will approach the pressure which is proportional to the square of the speed. Conversely, as the rod member is moved towards the right, the size of the restrictor 61 will be increased and the pressure will more nearly approach the outlet pressure of the feed pump. In other words, while the pressure supplied through the branch conduit is dependent upon the speed at which the engine is driven, it is also dependent upon the axial setting of the rod 41 which is representative of the load on the engine.

Figure 3:
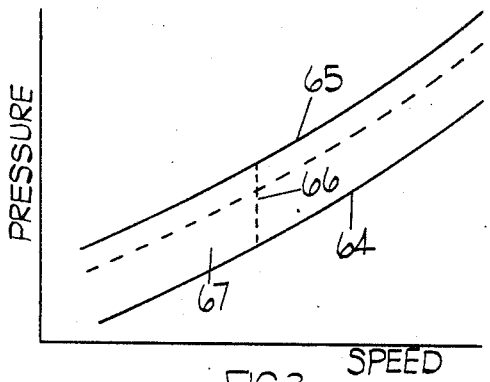
FIG. 3 is a graph showing various pressures existing in the arrangement of FIG. 1.

FIG. 3 illustrates the variation in pressure with speed, and a lower curve referenced 64 represents the pressure within the right hand end of the passage 46 while an upper curve referenced 65 shows the outlet pressure of the feed pump. Both these pressures are, of course, insenstivie to viscosity, and it will be appreciated that for a given speed, variation in the setting of the metering valve by the operator will cause the pressure in the branch conduit 45 to vary along a substantially vertical line indicated at 66. It will be appreciated that with varying speed, then the pressure in the branch passage 45 will vary for a given load, along a curve indicated at 67 and disposed substantially parallel to the curves 64 and 65.

In the example described, restrictor 53 is permanently in the fluid circuit with restrictors 61 and 47 connected in series and effectively in parallel with restrictor 53. It is possible to eliminate the restrictor 53, and the connection through it between the outlet of the feed pump and the device 63. In this case, the restrictors 61 and 47 provide the flow of fuel necessary so that the device 63 can regulate the pressure, but it will be appreciated that in no circumstances can the restrictor 61 be closed, otherwise there would be no flow of fuel for control by the device 63.

Figure 4:
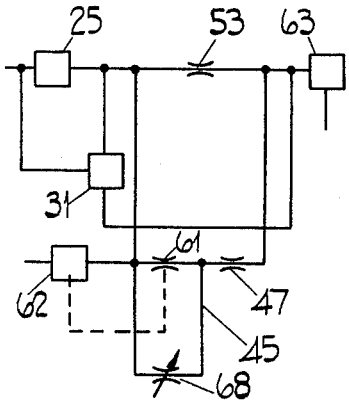
FIG. 4 is a fluid circuit diagram of a first modification.
Figure 5:
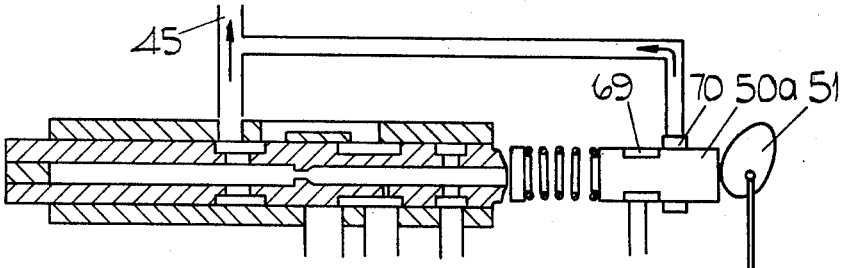
FIG. 5 shows a practical embodiment of a portion of the apparatus of FIG. 4.
Figure 6:
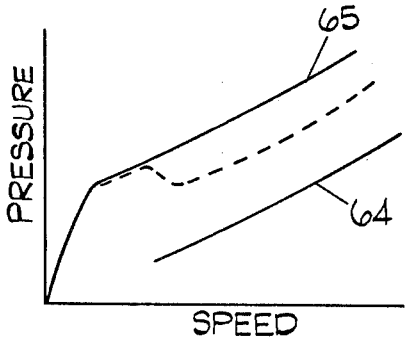
FIG. 6 is a graph showing the pressures existing in the first modification.

In some instances, it is desirable to provide special adjustment of the cam ring 13 at idling speeds and to move the cam in the direction of advancing the timing. This can be achieved by modifying the apparatus shown in FIGS. 1 and 2 as shown in FIG. 4, by providing an additional restrictor 68 in parallel with restrictor 61. Flow of fuel through the restrictor 68 is controlled effectively by the operator and for this purpose, the abutment 50 shown in FIG. 1, is modified to provide the equivalent of a valve. As shown in FIG. 5, the abutment **50*a* is provided with a circumferential groove 69 which is in constant communication with the outlet of the feed pump. Moreover, the groove is arranged to register when the operator control member 51 is in the idling position, with a port 70 which communicates with the branch conduit 45. The effect of this modification is seen in FIG. 6. At idling speeds, the restrictor 61 is effectively by-passed so that the pressure in the branch conduit is the same as the outlet pressure of the feed pump. This condition pertains with increasing engine speed until the port 70 is gradually obturated by the abutment 50*a* and the curve of pressure in the branch conduit begins to follow the curve 67 seen in FIG. 3.**

Figure 7:
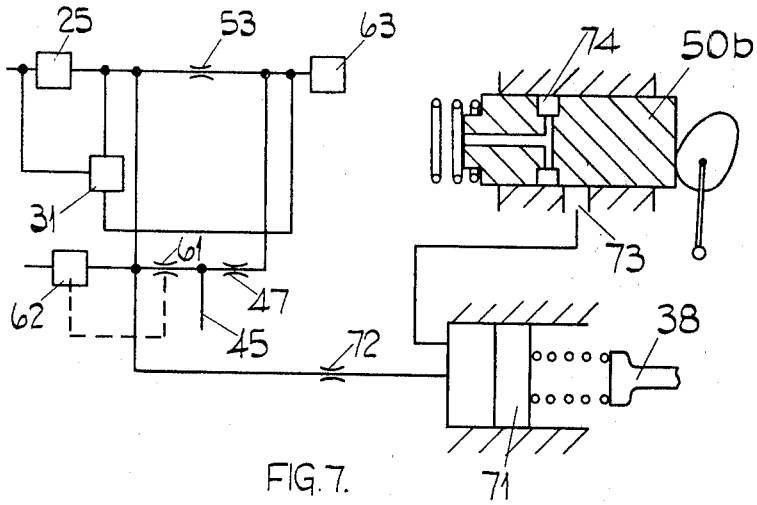
FIG. 7 shows a second modification of the apparatus of FIG. 1.

An alternative arrangement to the arrangement shown in FIGS. 4 and 5 is shown in FIG. 7. In this arrangement, a piston 71 is provided and which controls the force exerted by the spring which acts against the head 38 of the servo-valve which is contained within the piston 39. One end of the cylinder containing the piston is in communication with the outlet of the feed pump by way of a restrictor 72, and this end of the cylinder is also in communication with a valve constituted by the operator adjustable abutment **50*b*. The valve includes a port 73 formed in the wall, and a circumferential groove 74 on the abutment and which is in constant communication with a drain. In the idling position, the groove 74 is in register with the port 73 so that the pressure acting upon the piston 71 is low, and the piston is moved to the end of the cylinder thereby altering the setting of the servo-valve. As the operator adjusts the abutment 50*b* to increase the amount of fuel supplied to the engine, the groove 74 is moved out of register with the port 73 and the pressure to which the piston 71 is subjected increases, so that an adjustment in the setting of the servo-valve is obtained. A similar effect can be obtained by omitting the restrictor 72 and supplying fuel under pressure from the outlet of the feed pump by way of the valve constituted by the abutment. In this case, the axial positions of the port 73 and the groove 74 as seen in FIG. 7 are reversed and the groove 74 is in constant communication with the cylinder containing the piston 71 while the port 73 is in constant communication with the outlet of the feed pump. It will thus be seen that as the abutment is moved to increase the amount of fuel, fuel under pressure will be supplied to the cylinder containing the piston, and the effect will be exactly the same as with the arrangement of FIG. 7.** It will be appreciated, however, that there will be no loss of fuel at idling speeds, and in particular when starting the engine.

Figure 8:
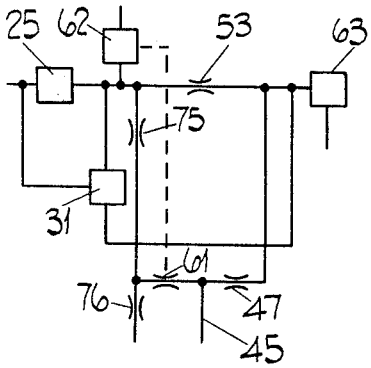
FIG. 8 shows a fluid circuit of a third modification of the apparatus of FIG. 1.
Figure 9:
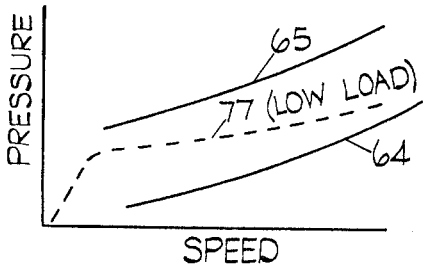
FIG. 9 is a graph showing various pressures in the arrangement of FIG. 8, FIGS. 10 and 11 are similar to FIGS. 8 and 9 and show a fourth modification.
Figure 10:
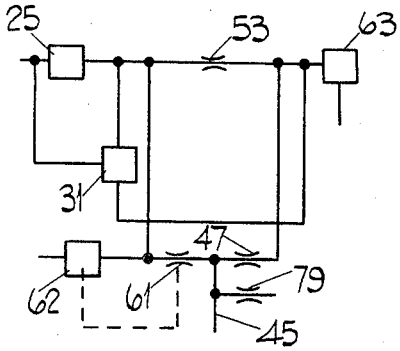

In certain circumstances, it may be desirable for the curve 67 shown in FIG. 3, to converge with increasing speed, with the curve 64. This is achieved as shown in FIG. 8, by providing two additional restrictors 75 and 76. Restrictor 75 is inserted in series with restrictor 61 and the outlet of the feed pump, while restrictor 76 is interposed between a point intermediate the restrictors 61 and 75 and a drain. The effect of this is seen in FIG. 9, and it will be seen that a curve 77 representing the pressure in the branch conduit 45 approaches with increasing speed, and for a given low load, the curve 64. The restrictors 75 and 76 can be provided by suitable shaping of the periphery of the sleeve 40 to provide a restriction adjacent the port 60 and a drain including a restrictor from adjacent the port 59 as seen in FIG. 1.

Figure 11:
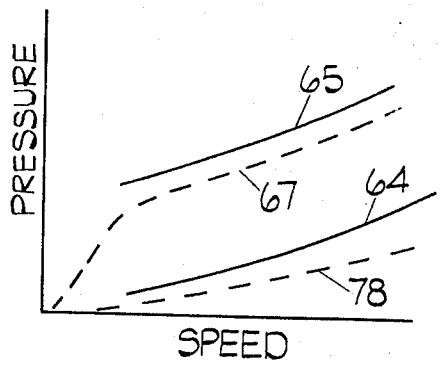

It may also be desirable to arrange that the pressure in the branch conduit 45 when the load is high, diverges relative to the curve 64. This is illustrated in FIG. 11, with the curve in question being referenced 78. It will be seen that the low load curve 67 is substantially unaffected. The effect is achieved by providing an additional restrictor 79 which extends from the branch conduit 45 to a drain. The additional restrictor may be formed in the plug which closes the left hand end of the passage 46, of the rod member 41.

Figure 12:
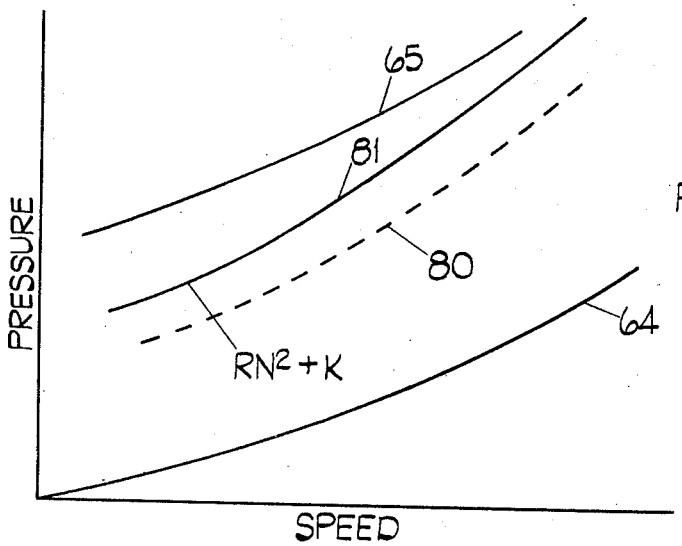
FIG. 12 is a graph demonstrating a modification applicable to all the arrangements described.

It is desirable for a given load on the engine that the metering valve position should remain constant throughout the speed range, and particularly at high loads. This avoids movement of the metering valve on the part of the operator, and which inevitably results in variations in the load signal in the branch conduit 45. In other words, while the load on the engine may be constant, the metering valve is being moved by the operator to maintain the load constant, and this movement effects an adjustment of pressure in the branch conduit so that the pressure varies as if the load were changing. In order to minimize this difficulty, the output pressure of the feed pump can be adjusted so that it more nearly corresponds with the pressure of fuel downstream of the metering valve, and which is required to effect movement of the shuttle 19 in the outward direction. FIG. 12 illustrates the curves 64 and 65 as previously described. A curve 80 represents the metering pressure at high load, and a curve 81 represents the modified output pressure of the feed pump which is obtained as will be described with reference to FIG. 13.

Figure 13:
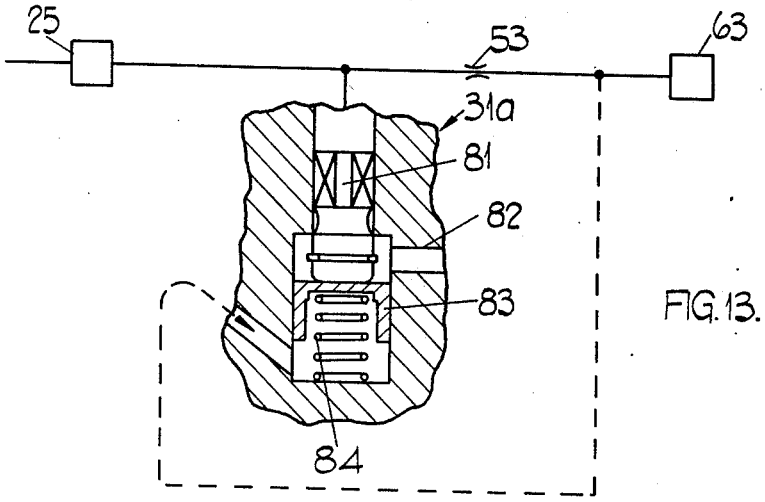
FIG. 13 shows a modification to the apparatus of FIG. 1 required to achieve the effect demonstrated in FIG. 12.

Referring to FIG. 13, this shows the relief valve 31*a* and it includes a fluted valve element 81 having a groove formed in its periphery which can be exposed beyond the end of a step in the cylinder in which it is located. The valve member 81 is urged by the pressure of fuel to expose the groove to allow spillage of the fuel from the outlet of the feed pump, with the spilled fuel flowing through a passage 82 back to the inlet of the feed pump. The wider portion of the bore in which the valve member is located, accommodates a piston 83 which is urged by a spring 84 into contact with the valve member 81. Moreover, the spring acts to oppose movement of the valve member by the fuel under pressure from the outlet of the feed pump. The chamber containing the spring 84 communicates, as in the previous examples, with a point intermediate the restrictor 53 and the device 63. The ratio of areas of the piston and valve member is a constant R and the force exerted by the spring 84 represents a constant K. The law of the curve 81*a* is $RN^2 + K$. It will be appreciated that in this example, the force exerted by the spring 84 is less than that exerted by the spring 57. With this modification, the curves 80 and 81 become substantially parallel to each other so that for a given load on the engine, the setting of the rod member 41 does not have to be adjusted throughout the speed range. This modification can be applied to all the embodiments described and improves the performance thereof.

I claim:

1. A liquid fuel injection pumping apparatus for supplying fuel to internal combustion engines, the apparatus comprising an injection pump adapted to be driven in timed relationship with an associated engine, fluid pressure operable means for effecting adjustment of a component of the injection pump, a feed pump for supplying fuel to the injection pump during the filling periods thereof, a throttle valve for controlling the amount of fuel supplied to the injection pump, a relief valve including a valve member movable by the outlet pressure of the feed pump to an open position in which fuel is spilled from the outlet of the feed pump, resilient means acting to urge the valve member to a closed position, means for generating a first pressure which is lower than the outlet pressure of the feed pump, but which varies in accordance with the speed at which the injection pump is driven, conduit means through which said first pressure is applied to said valve member to assist the action of the resilient means whereby the outlet pressure of the feed pump has a value higher than said first pressure, a further conduit interconnecting the outlet of the feed pump and said means whereby flow of fuel will occur along said further conduit due to the difference in pressure between the ends thereof, a pair of restrictors in said further conduit, a branch conduit extending from intermediate said restrictors, and through which the pressure intermediate said restrictors is transmitted to said fluid pressure operable means, with the size of one of said restrictors being adjustable in accordance with the setting of the throttle valve whereby the fluid pressure applied to said fluid pressure operable means will depend both upon the speed at which the injection pump is driven, and also upon the setting of the throttle valve.

2. The apparatus as claimed in claim 1 in which said means comprises a centrifugally controlled valve which spills fuel from downstream of said restrictors thereby to generate said first pressure.

3. The apparatus as claimed in claim 2 including a third restrictor connected intermediate the outlet of the feed pump and said means.

4. The apparatus as claimed in claim 2 in which it is the size of the upstream one of said pair of restrictors which is adjustable in accordance with the setting of the throttle valve.

5. The apparatus as claimed in claim 4 including an axially movable rod member, a centrifugal weight disposed at one end of the rod member, a plate disposed at the other end of the rod member, resilient means acting on said plate in opposition to the force exerted by said weight, an operator adjustable member constituting an abutment for said resilient means, a bore extending within said rod member, a plug closing said bore at said one end of the member, the other end of said bore being closed by said plate, a restriction intermediate the ends of the bore, said restriction constituting the other restrictor of said pair of restrictors, a sleeve surrounding said rod member, a first port formed in said sleeve, a first groove formed in said rod member and communicating with the closed end of said bore, said first groove and first port constituting the upstream one of said pair of restrictors, a second port formed in said sleeve, a second groove in said rod member, said second groove and second port constituting said throttle valve, the arrangement being such that as the rod member is moved axially to adjust the degree of registration of said second port and second groove thereby to alter the amount of fuel supplied to the engine the degree of registration of said first port and the first groove will be altered, said plate lifting from the open end of said bore to generate said first pressure.

6. An apparatus as claimed in claim 5 in which said second groove and said first port are in constant communication with the outlet of the feed pump and said first groove communicates with said fluid pressure operable means.

7. An apparatus as claimed in claim 6 including passage means in the rod member and sleeve and through which the open end of said bore communicates with said relief valve.

8. An apparatus as claimed in claim 7 in which said abutment and a surrounding wall define a fourth and variable restrictor connected in parallel with the one of said pair of restrictors, whereby at low speeds the pressure of fuel applied to said fluid pressure operable means will be substantially equal to the outlet pressure of the feed pump.

9. An apparatus as claimed in claim 7 in which said fluid pressure operable means includes a spring loaded control valve which is subjected to the pressure in said branch conduit, the apparatus including a piston movable to adjust the force exerted by the spring loading the control valve, and valve means constituted by said abutment to adjust the pressure applied to said piston.

10. An apparatus as claimed in claim 7 including a fifth restrictor interposed between the outlet of the feed pump and the upstream one of said pair of restrictors, and a sixth restrictor extending to a drain from intermediate said fifth restrictor and the upstream one of said pair of restrictors.

11. An apparatus as claimed in claim 7 including a seventh restrictor position in a passage communicating with a drain and extending from said branch passage.

12. The apparatus as claimed in claim 1 in which said relief valve includes a piston element subjected to said first pressure and engaging with the valve member to assist the action of said resilient means, the ratio of areas of the faces of the valve member and piston element which are subjected to fuel pressure being R, the speed/pressure characteristic of the output pressure of the feed pump being $RN^2 + K$ where N is the speed and K the spring constant.

* * * * *